US011717064B1

(12) United States Patent
Kale

(10) Patent No.: US 11,717,064 B1
(45) Date of Patent: Aug. 8, 2023

(54) RUNNING RING JEWELRY APPARATUS

(71) Applicant: James Matthew Kale, Greenacres, WA (US)

(72) Inventor: James Matthew Kale, Greenacres, WA (US)

( * ) Notice: Subject to any disclaimer, the term of this patent is extended or adjusted under 35 U.S.C. 154(b) by 6 days.

(21) Appl. No.: 17/712,125

(22) Filed: Apr. 2, 2022

(51) Int. Cl.
*A44C 9/00* (2006.01)

(52) U.S. Cl.
CPC ..... *A44C 9/0053* (2013.01)

(58) Field of Classification Search
CPC ..... A44C 9/003; A44C 9/0053
USPC ..... 446/332, 333, 334, 335
See application file for complete search history.

(56) References Cited

U.S. PATENT DOCUMENTS 1,216,632 A * 2/1917 Walker et al. ..... A63H 7/02 446/333
4,177,602 A * 12/1979 Choi ..... A63H 11/20 446/355
D639,199 S * 6/2011 Liberman ..... D11/26
D760,109 S * 6/2016 Liberman ..... D11/33
9,445,652 B1 * 9/2016 Yousef ..... A44C 17/0258
2012/0090356 A1 * 4/2012 Liberman ..... A44C 9/003 63/3

* cited by examiner

*Primary Examiner* — Emily M Morgan

(57) ABSTRACT

A jewelry ring designed to be worn on the finger of a hand, having rotating halves that when rotated against one another cause the legs of a Horse or other figure attached to the outward face to move in a naturally articulate manner or run. The rings assembly consists of an inner and outer cylinder that contain one or more inner gears or friction driven cylinders which are positioned perpendicular relative to the center axis of the rotating cylinders and are held in place by the two cylinders. When the cylinders of the ring are rotated in opposing directions the cylinders that are positioned perpendicular to the center axis rotate. The rotational movement of the cylinders that are positioned perpendicular to the center axes cause the leg elements, consisting of upper and lower sections, connected to the cylinder and the Horse or other figure by rotational joints, to move in a fashion designed to mimic the natural leg movement of the horse or other figure on the ring or to appear to run.

3 Claims, 6 Drawing Sheets

RUNNING RING JEWELRY APPARATUS

FIELD OF THE INVENTION

The present invention relates to a mechanism to provide the means for the movement of legs on a rotating wheel to simulate the running motion of a Horse figure embossment on a Ring type piece of Jewelry that fits onto a human finger.

The present invention relates to a mechanism to provide the means for the movement of legs on a rotating wheel to simulate the running motion of a Dog figure embossment on a Ring type piece of Jewelry that fits onto a human finger.

The present invention relates to a mechanism to provide the means for the movement of legs on a rotating wheel to simulate the running motion of a Cat figure embossment on a Ring type piece of Jewelry that fits onto a human finger.

The present invention relates to a mechanism to provide the means for the movement of legs on a rotating wheel to simulate the running motion of a Alligator figure embossment on a Ring type piece of Jewelry that fits onto a human finger.

The present invention relates to a mechanism to provide the means for the movement of legs on a rotating wheel to simulate the running motion of a Human figure embossment on a Ring type piece of Jewelry that fits onto a human finger.

The present invention relates to a mechanism to provide the means for the movement of legs on a rotating wheel to simulate the running motion of a Four Legged Animal figure embossment on a Ring type piece of Jewelry that fits onto a human finger.

The present invention relates to a mechanism to provide the means for the movement of legs on a rotating wheel to simulate the running motion of a two Legged Mammal figure embossment on a Ring type piece of Jewelry that fits onto a human finger.

BACKGROUND OF THE INVENTION

The advancing technologies related to Computer Aided Design software and the ability to take the virtual shapes created from the CAD software and have them made into metal castings from printed polymer materials has greatly expanded the ability to create and produce new and exciting inventions. Utilizing these advancing technologies provides the foundation for this Ring type Jewelry invention that allows for the exhibition of multiple types of figures, both animal and human, in a Running form, onto a cylindrical mechanical assembly of which is configured in a size and shape to fit onto a human finger or other similar sized protrusions. This is achieved by fixing an embossment of a animal or human figure onto an outer cylinder that is allowed to rotate about an inner cylinder. When the rotation between the cylinders is manipulated, Limbs or Legs, which are attached to the figure and a corresponding wheel of which is driven by the inner cylinder and the rotational movement between the inner and outer cylinders, causes the Limb or Leg elements to move in a articulated way which is designed to simulate the movement of the Limbs or Legs in a Running motion of the figure or figures represented on the Ring type Running Ring Jewelry invention.

SUMMARY OF THE INVENTION

The present invention provides a jewelry item described as a Ring that fits onto a human finger and can be worn as a piece of jewelry having multiple rotating Wheels that manipulate multiple Limb or Leg type elements connected to multiple figures of Horses that simulate the running motion of the horses when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of Dogs that simulate the running motion of the dogs when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of Cats that simulate the running motion of the cats when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of Alligators that simulate the running motion of the Alligators when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of Humans that simulate the running motion of the Humans when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of a Four Legged Animals that simulate the running motion of the Four Legged Animals when opposing cylinders are manually rotated against one another.

The present invention provides a jewelry item described as a Ring that fits onto a human finger and can be worn as a piece of jewelry having multiple rotating Wheels that manipulate multiple Limb or Leg type elements connected to multiple figures of a Two Legged Mammal that simulate the running motion of the Two Legged Mammal when opposing cylinders are manually rotated against one another.

BRIEF DESCRIPTION OF THE DRAWINGS

A clear understanding of the key features of the invention summarized above may be had by reference to the appended drawings which illustrate the method and system of the invention, Although it will be understood that such drawings depict preferred embodiments of the invention and, therefore, are not to be considered as limiting its scope with regard to other embodiments which the invention is capable of contemplating. Accordingly.

DETAILED DESCRIPTION OF THE INVENTION

Overview

The terminology used herein is for the purpose of describing particular embodiments only and is not intended to be of any limiting factor or factors of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims

FIGURES

Figure 1:
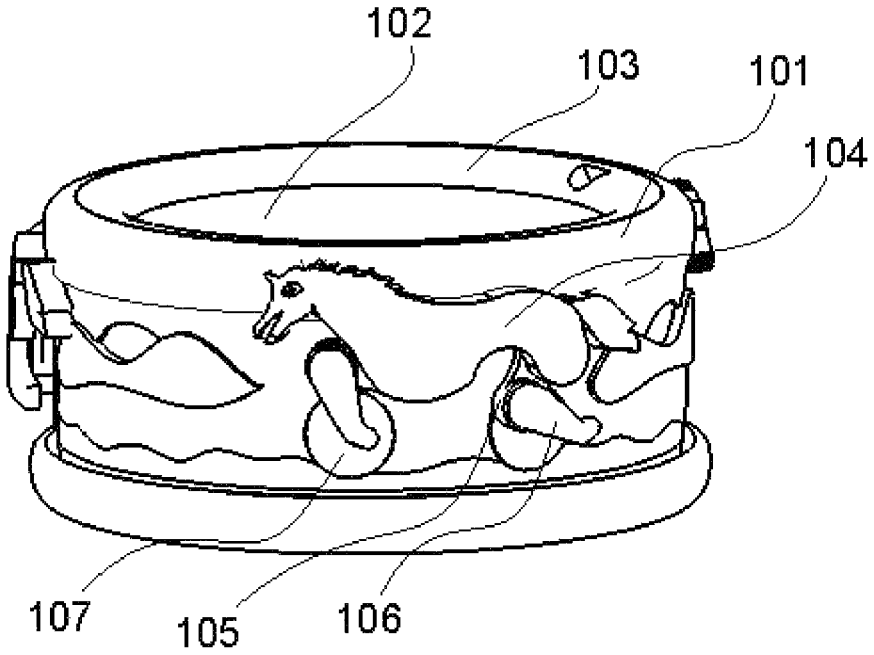
FIG. 1 is an illustration of the method and system of this invention in a perspective view showing the overall view of the invention.
Figure 5:
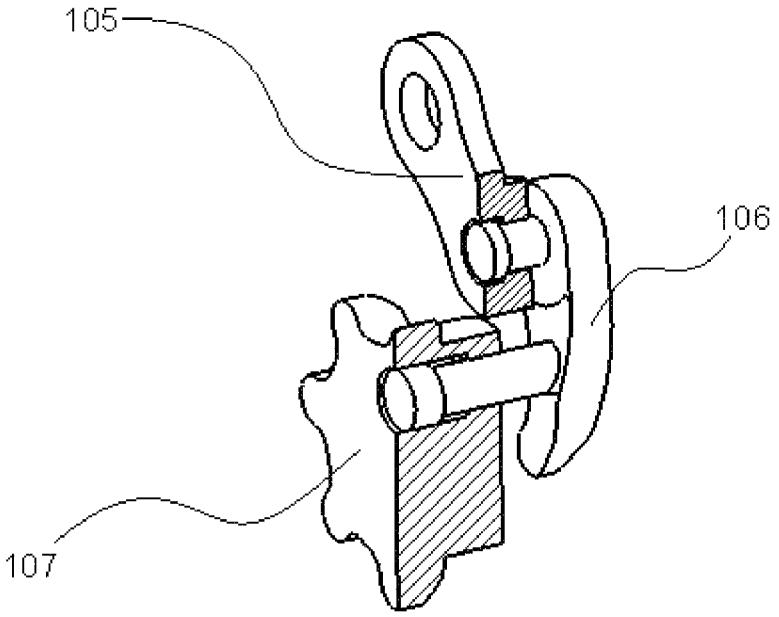
FIG. 5 is an illustration of the method and system of this invention in a cutaway perspective view of the legs or limbs of the Horse, Animal or Human figure represented on the invention and how they are attached to the driving Wheel with a pivoting joint while also showing the pivoting joint that joins together the upper and lower leg or limb segments of the Horse, animal or Human figure of the invention.
Figure 7:
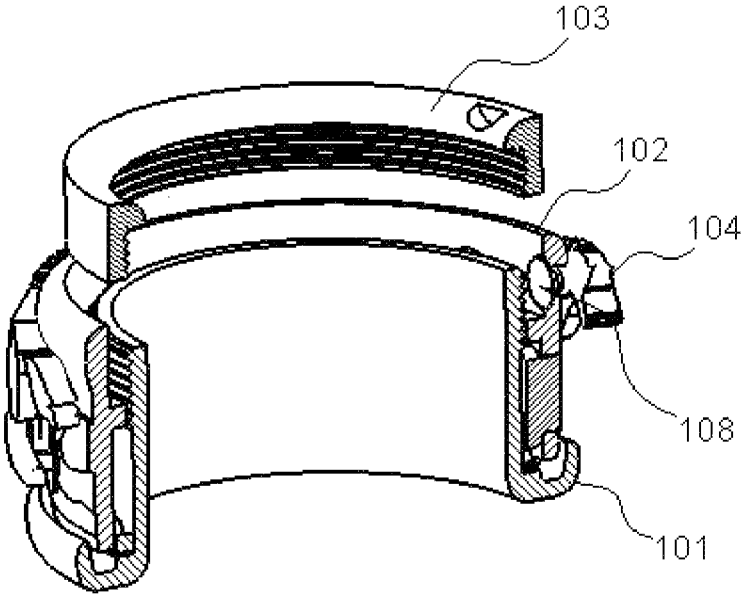
FIG. 7 is an illustration of the method and system of this invention in a cutaway exploded view of the Horse, Animal or Human figure represented on the invention showing the method of fastening the Horse, animal or Human figure onto the outer rotating Cylinder of the invention.

FIG. 1, Cylinder 102 is contained within Cylinder 101 and held into place by the Containment Ring 103. Cylinder 101 is free to rotate about Cylinder 102 in which the Horse, animal or Human figure represented on the invention 104 is attached. The Upper and Lower Leg or Limb segments of the Horse, Animal or Human figure represented on the invention, 105 and 106 are joined to the Horse, Animal or Human figure represented on the invention, 104, by a pivoting joint and then attached to one another by a second pivoting joint of which the construction of is illustrated in FIG. 5. The Lower Leg or Limb element of the Horse, Animal or Human figure represented on the invention, 104 is attached to the Wheel element 106 as illustrated in FIG. 7 of which rotational motion is driven by the Cylinder 101 and contained by the Cylinder 102.

Figure 2:
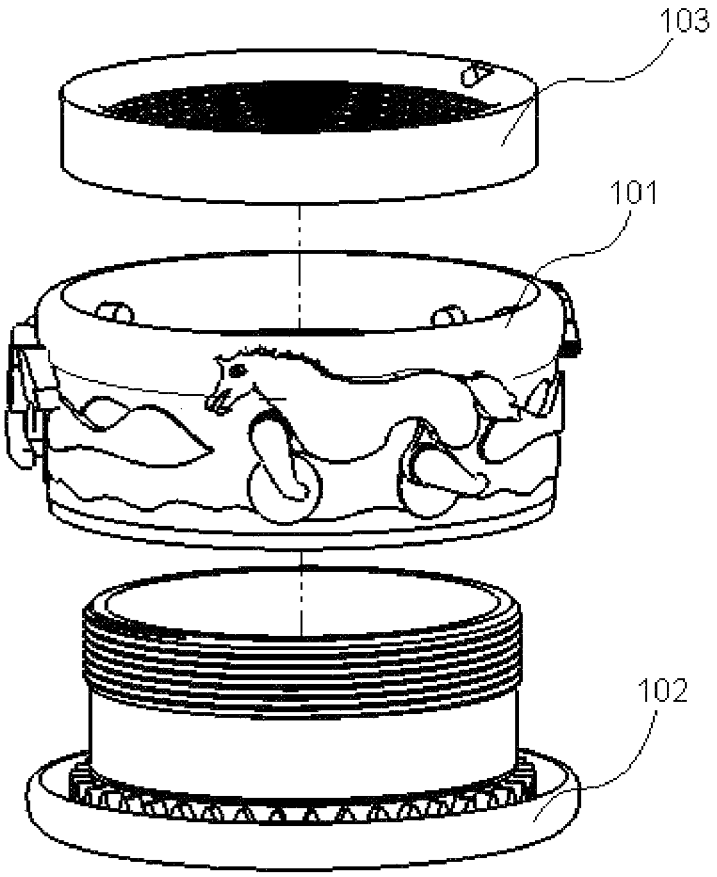
FIG. 2 is an illustration of the method and system of this invention in an exploded view showing the rotating opposing cylinder mechanism of the invention.

FIG. 2, Cylinder 102 is contained within Cylinder 101 and held into place by the Containment Ring 103. Cylinder 101 is free to rotate about Cylinder 102, and the Containment Ring 103 is fastened to Cylinder 102 by means of an integrated helical screw thread or by two screw type fasteners that fasten the Containment Ring 103 and Cylinder 102 rotating cylinders together by mounting in line with the centerline of the 101 and 102 Cylinders and perpendicular the their opposing surfaces.

Figure 3:
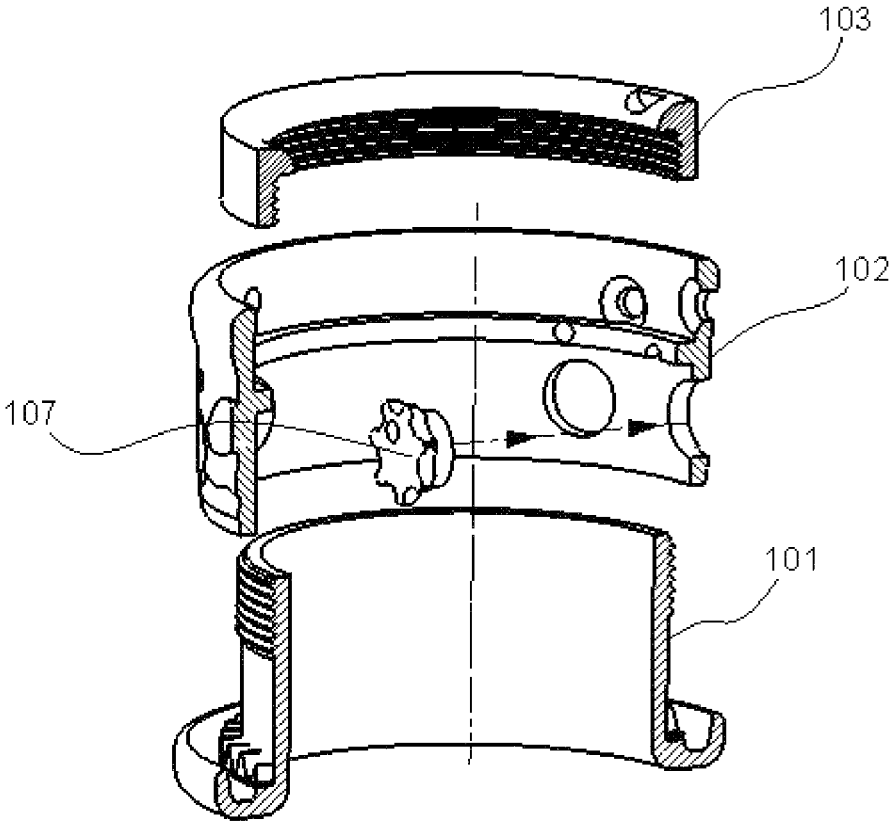
FIG. 3 is an illustration of the method and system of this invention in an exploded view showing the method of containing the rotating wheels of the invention that drive the legs or limbs of the Horse, Animal or Human figure represented on the invention.

FIG. 3, The rotating Wheel 107 is contained in the Cylinder 102 and is held in place by the Cylinder 101 which is retained in Cylinder 102 by the Containment Ring 103.

Figure 4:
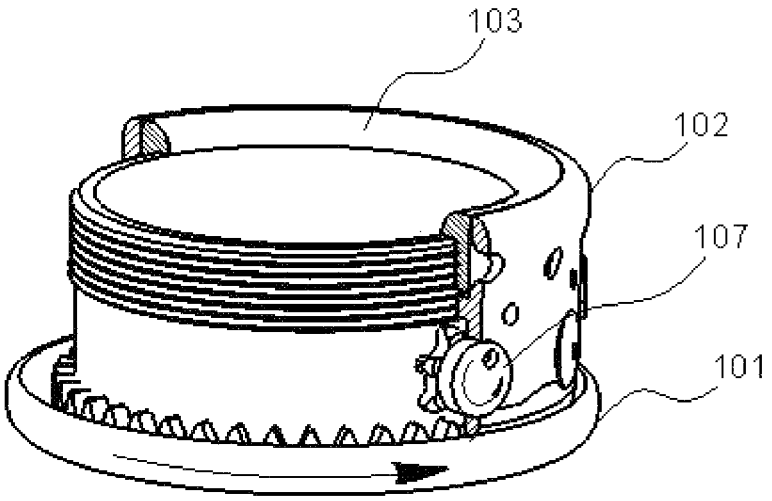
FIG. 4 is an illustration of the method and system of this invention in a cutaway perspective view showing one of the rotating wheels which turns and drive the Legs or Limbs of the Horse, Animal or Human figure represented on the invention by contacting the rotating opposing cylinder mechanism of the invention.

FIG. 4, The rotating Wheel 107 is contained in Cylinder 102 and is held in place by Cylinder 101 which is contained by the Containment Ring 103 and is driven by the Cylinder 101 by means of a gear or friction type interface.

FIG. 5, The Lower Leg or Limb element 106 is contained in the Wheel 107 and allowed to pivot freely. The Upper Leg or Limb element 106 is contained in the Lower Leg element 105 and allowed to pivot freely.

Figure 6:
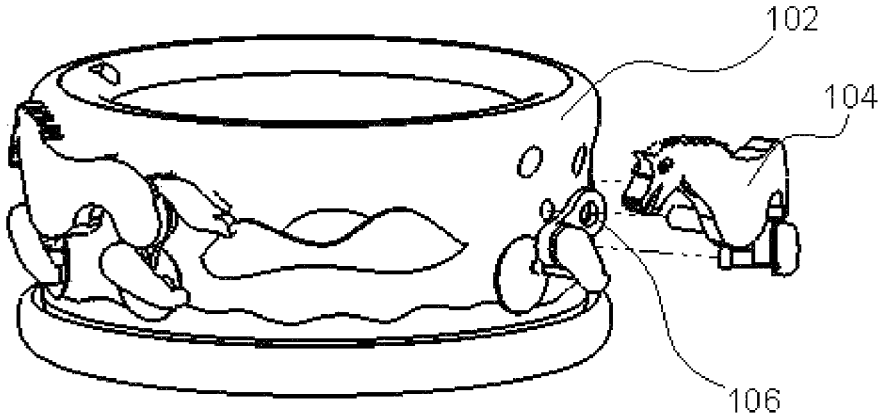
FIG. 6 is an illustration of the method and system of this invention in a perspective view of the Horse, Animal or Human figure represented on the invention and the attachment method of the upper pivoting joint of Legs or Limbs of the Horse, animal or Human figure and how it is fitted to the outer opposing cylinder mechanism of the invention.

FIG. 6, The Upper Leg or Limb element 106 is contained by the Horse element 104 and allowed to pivot freely on a rod or cylinders axis which is attached to the Horse element 104, all of which is contained by the Cylinder 102.

FIG. 7 The Horse element 104 is attached to the Cylinder 102 by means of a swaged type pin attachment 108. Cylinder 102 is free to rotate about Cylinder 101 and is held into place by the Containment ring 103.

Figure 8:
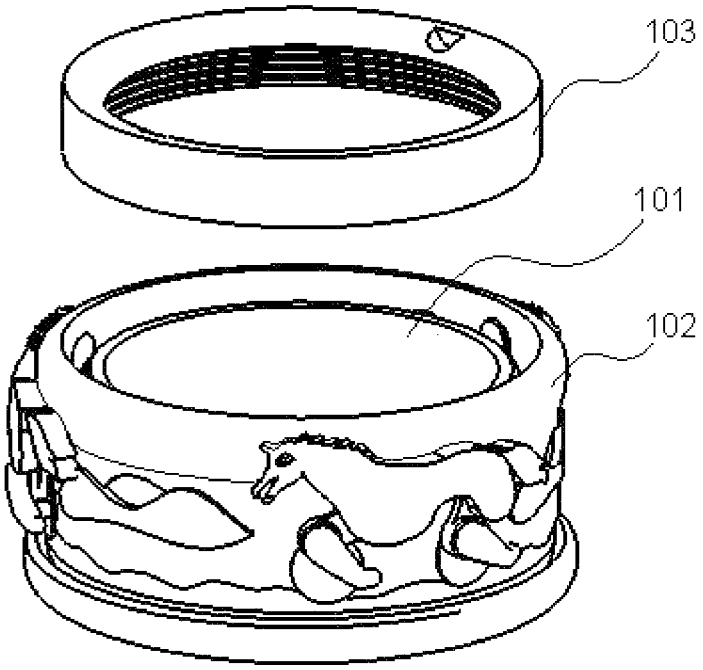
FIG. 8 Depicts an illustration of the method and system of this invention in an exploded view of the invention showing the Capture Ring that holds the Inner and Outer Cylinders of the invention together.

FIG. 8 Cylinder 102 is attached to the Containment Ring 103 by means of a helical screw thread. Cylinder 102 can also be attached to the Containment Ring 103 by means of screw fasteners located perpendicular to the centerlines of Cylinder 102 and the Containment Ring 103.

The invention claimed is:

1. A ring, comprising:

a first component comprising a cylindrical portion having a first end and a second end, a flange with an interface at the first end, and an external thread at the second end, the cylindrical portion having a through hole with a diameter sized to be worn on a finger; and a second component having a circular cross section and sized to fit and rotate around the cylindrical portion of the first component, the second component having a through hole with a wheel inserted therein, the wheel is capable of rotating within the second component; and a containment ring engaging the external thread of the first component and configured to retain the second component on an exterior surface of the first component;

wherein the wheel engages the interface of the first component so that the wheel rotates within the second component during circumferential rotation of the second component around the cylindrical portion of the first component.

2. The ring of claim 1, further comprising an ornamentation on an external surface of the second component and the wheel.

3. The ring of claim 2, the ornamentation further comprising an image of a body on the second component, and an image of a limb on the wheel, such that the ornamentation resembles running while the second component and wheel rotate.

* * * * *